United States Patent [19]

Craig

[11] Patent Number: 5,045,874

[45] Date of Patent: Sep. 3, 1991

[54] WATER DISTRIBUTOR SYSTEM FOR CROSSOVER ASSEMBLIES IN A FILM PROCESSOR

[75] Inventor: William A. Craig, Rochester, N.Y.

[73] Assignee: Eastman Kodak Company, Rochester, N.Y.

[21] Appl. No.: 609,481

[22] Filed: Nov. 5, 1990

[51] Int. Cl.[5] ..... G03D 3/06; G03D 3/08

[52] U.S. Cl. ..... 354/322; 354/324

[58] Field of Search ..... 354/320, 321, 322, 324, 354/325

[56] References Cited

U.S. PATENT DOCUMENTS

| | | | |
|---|---|---|---|
| Re. 30,328 | 7/1980 | Huss | 354/322 |
| 1,905,733 | 4/1933 | Moore . | |
| 3,864,938 | 2/1975 | Hayes, Jr. | 62/504 |
| 4,123,769 | 10/1978 | Fernandez et al. | 354/322 |
| 4,230,404 | 10/1980 | Huss | 354/321 |
| 4,695,147 | 9/1987 | Thibault | 354/322 |
| 4,807,657 | 2/1989 | Van Den Bergh | 137/101 |
| 4,829,330 | 5/1989 | Yamada et al. | 354/322 |
| 4,839,683 | 6/1989 | Kushima et al. | 354/322 |
| 4,853,728 | 8/1989 | Hall | 354/320 |

*Primary Examiner*—A. A. Matthews

*Attorney, Agent, or Firm*—G. Herman Childress

[57] ABSTRACT

Film is developed in a processor by passing it through a container of development solution, then a container of a fixer solution, and then the film is passed through a wash container where it is washed with water before delivery to a dryer. As the film is transported from the developer container to the fixer container, and from the fixer container to the wash container, it travels through crossover assemblies having a roller that is rotatable in a trough of water so that the roller is constantly cleaned of developer or fix solutions. A water distributor system for delivering water to the crossover assemblies has a channel for water which has one end located to deliver water to the trough in the first crossover assembly and a second end located to deliver water to the trough of the second crossover assembly. Water is metered from a single conduit to the channel and separated into separate streams for delivery to the two troughs.

5 Claims, 3 Drawing Sheets

WATER DISTRIBUTOR SYSTEM FOR CROSSOVER ASSEMBLIES IN A FILM PROCESSOR

BACKGROUND OF THE INVENTION

This invention relates to an improved distribution system for delivering water to troughs in crossover assemblies of a film processor.

Film processor are known that include containers for processing solutions, such as developer, fixer and water. A sheet or strip of film is fed along a film path through each of the solutions during development of the film. The film is transported from one container to another over crossover assemblies having one or more rollers which help feed the film from one container to another. A Processor of this general kind is known, for example, from U.S. Pat. No. 4,853,728, entitled "X Ray Film Processor Rack", which issued on Aug. 1, 1989 in the name of D. O. Hall. A residue of the processing fluid may be deposited on the crossover rollers in such a film processor as the film passes over the rollers. In some processors one of the rollers is partially immersed in a bath of water located in a trough beneath the roller to continuously clean the roller surface. Examples of water troughs for rollers in crossover assemblies are found in U.S. Reissue Pat. No. 30,328; U.S. Pat. Nos. 4,230,404 and 4,829,330, for example.

Ideally, water for a trough of a crossover assembly should be introduced into one end of the trough and water drained from the opposite end of the trough in order to provide good circulation of water and in order to prevent water in any portion of the trough from becoming stagnant. Thus, when two crossover assemblies are provided, separate water tubes could be provided to an end of each of the troughs with the tubes being connected to a suitable water supply. While the use of separate water tubes is satisfactory, it also is bulky, cumbersome and requires the operator to connect and disconnect both hoses during assembly, during repair of the processor, and for Jam clearance.

Some film processors have a wash container in which water is delivered to tubes in the wash container and sprayed through openings in the tubes directly onto the film as it passes through the wash container. These tubes may extend from one end to the other end of the wash container and have an end portion that is readily accessible and available as a water supply. It would be desirable to utilize this water supply as a source of water to the crossover assemblies.

SUMMARY OF THE INVENTION

Accordingly, it is an object of the present invention to provide a water distributor system for crossover assemblies in a film processor which is not bulky or cumbersome, and to such a system wherein the portion of the distributor system directly above the processing solutions can be easily assembled or removed for repair or jam clearance.

Another object of the invention is to provide such a water distributor system which is simple to manufacture and install and requires only a single water tube or conduit to supply water to two crossover assemblies.

The invention relates to an improved water distributor system for crossover assemblies in a film processor. The film processor has first, second and third containers for liquids through which film is successively passed for developing the film. A first crossover assembly is located between the first and second containers, and a second crossover assembly is located between the second and third containers Each crossover assembly has an elongate trough for holding water and a rotatable roller located with respect to the trough so that the roller is partially immersed in water in the trough to clean the roller. The film being processed contacts the roller of one of the crossover assemblies as the film travels from one container to another. The improved distributor system has a water distributor with means defining an elongate path for water. The path defining means has one end located to deliver water to the trough of the first crossover assembly and a second end located to deliver water to the trough of the second crossover assembly. Means are provided for metering water to the path defining means at a position between the ends thereof. Separating means separates water from the metering means into a first stream of water that is directed along the path toward the one end of the path while a second stream of water is directed along the path toward the second end of the path.

The invention, and its objects and advantages, will become more apparent in the Detailed Description of the Preferred Embodiment presented below.

BRIEF DESCRIPTION OF THE DRAWINGS

In the Detailed Description of the Preferred Embodiment of the invention presented below, reference is made of the accompanying drawings, in which.

DETAILED DESCRIPTION OF THE PREFERRED EMBODIMENTS

Figure 1:
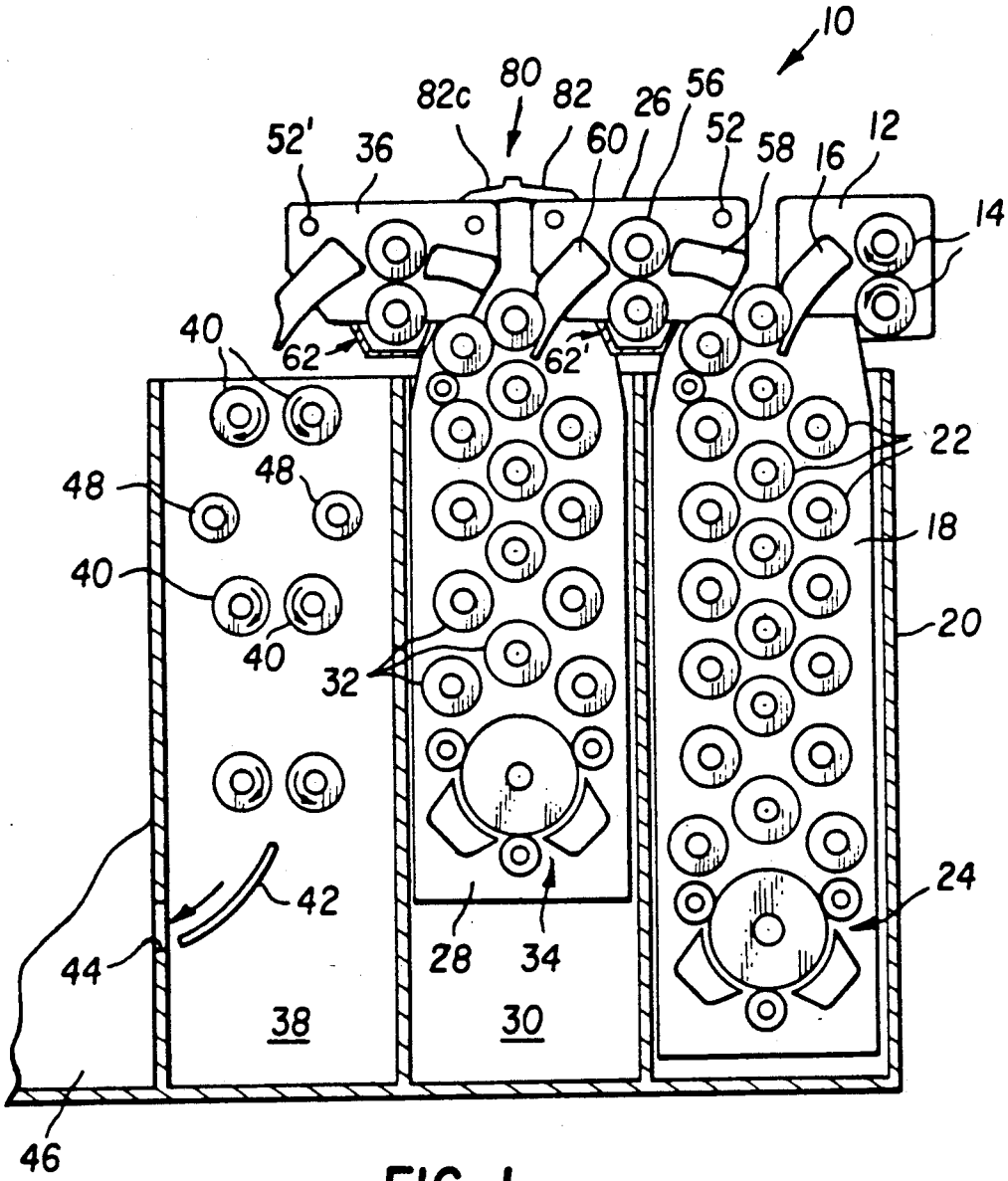
FIG. 1 is a side elevation view, partially in section, of a film processor incorporating a water distributor system of the invention.

Referring initially to FIG. 1 of the drawings, a film processor generally designated 10 has an entrance roller assembly 12 comprising a pair of nip rollers 14 that receives a sheet or strip of film and feeds the film into the processor for development of latent images on the film. A guide 16 directs the film downwardly into a developer rack 18 located in a container 20. The developer rack illustrated comprises a plurality of rollers 22 arranged in three vertical rows The two rows of rollers 22 shown at the right in FIG. 1 are rotated in directions to move the film downwardly from guide 16 to a turnaround assembly 24. The turn around assembly directs the film upwardly between the left row of rollers 22 and the center row of rollers Thus, the rollers in rack 18 are effective to circulate the film through a U shaped path in the container 20.

When the film reaches the top of the rack 18, it is directed by a crossover assembly generally designated 26 (described in more detail later) into a second rack 28 located in a second container 30. Rack 28, like rack 18, includes three rows of rollers 32 and a turnover assembly 34 which feeds the film in a U-shaped path through container 30.

When the film reaches the top of rack 28 it is directed by a crossover assembly 36 (described in more detail later) into a wash container 38. Sets of rollers 40 in container 38 drive the film downwardly until it reaches a guide 42 which directs the film through a slot 44 in the wall of container 38 and into a drying section, a fragment of which is shown at 46. As the film travels through container 38, it is sprayed with wash water from two spray headers 48 located on opposite sides of the film path.

In operation of processor 10 the film is transported through a developer fluid in container 20, then through a fixing fluid in container 30, the film is washed with water as it travels through the wash container 38, and then dried in dryer section 46. Film processors as generally described hereinbefore are known and need not described in more detail here. The water distributor system of the present invention can be used with processors as previously described or with other kinds of processing apparatus.

Figure 2:
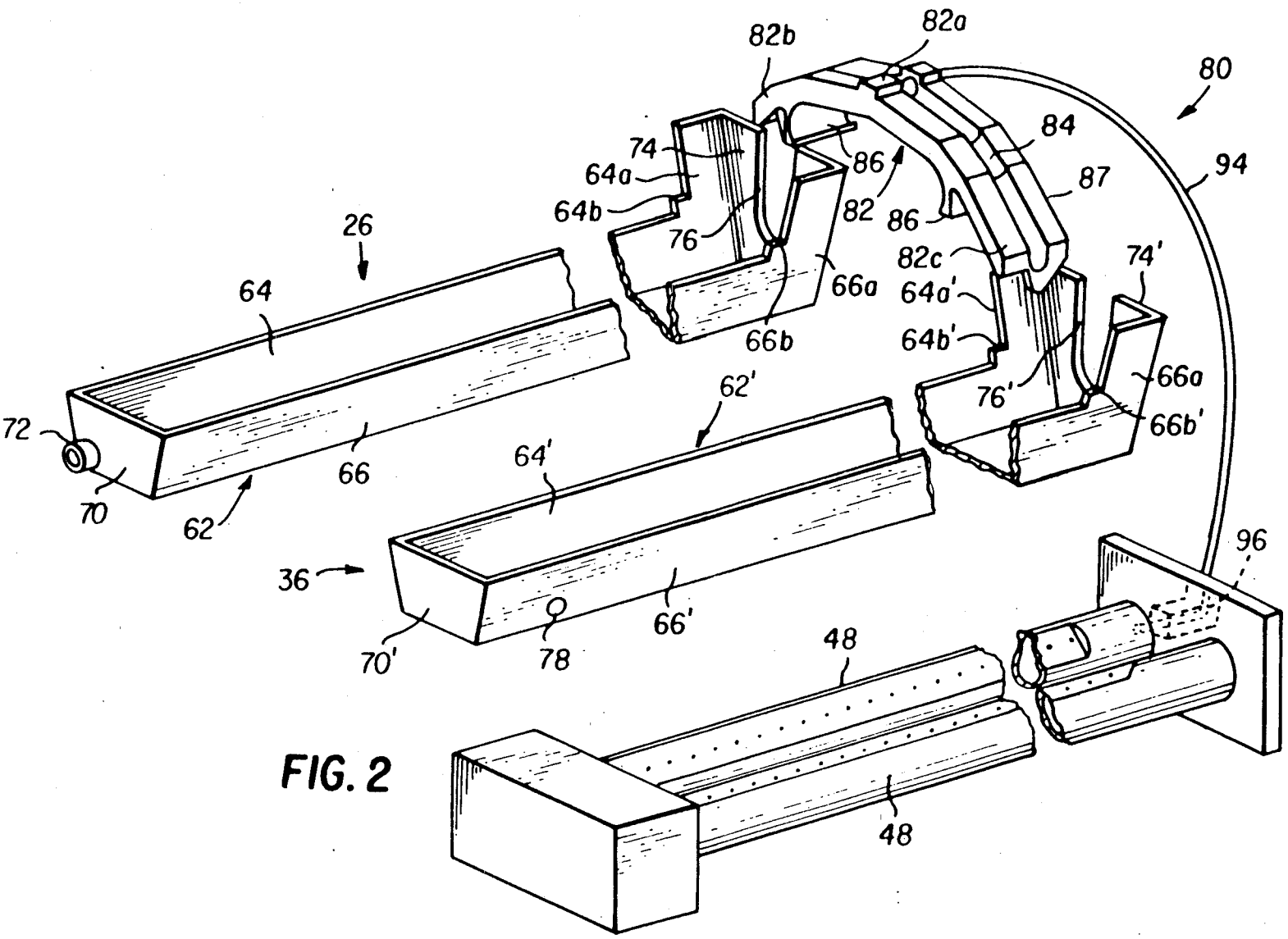
FIG. 2 is an enlarged perspective view of the water distributor system and portions of a crossover assembly with certain parts being omitted for clarity.
Figure 3:
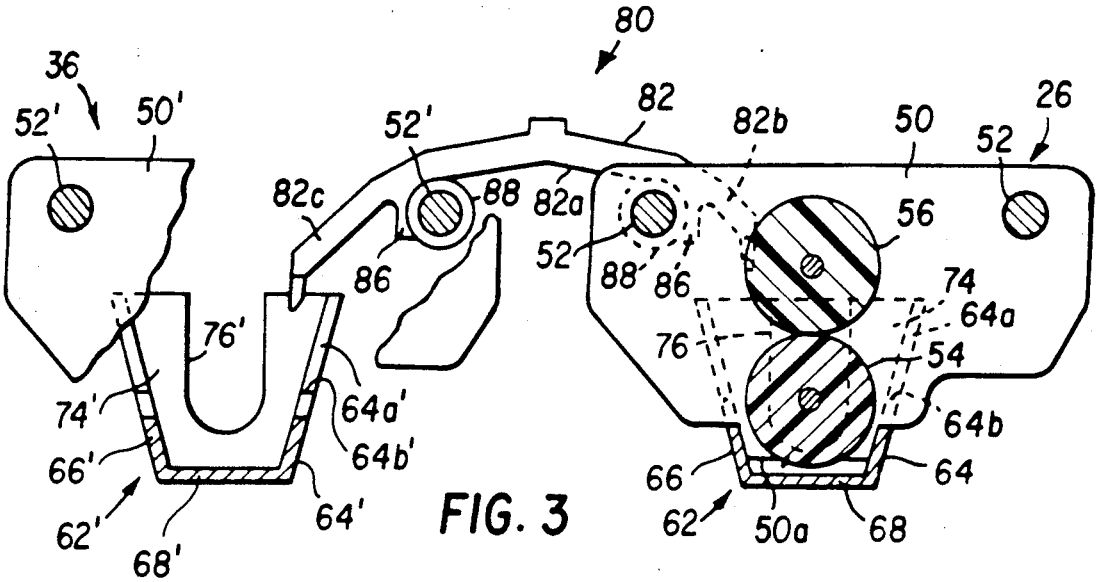
FIG. 3 is a fragmentary view of a portion of the crossover assemblies of FIG. 1 and the water distributor system of the invention.

Referring now to FIGS. 1-3, crossover assembly 26 comprises a pair of end plates 50 at opposite ends of the assembly, only one of which is illustrated A plurality of rods 52 extend between the end plates to hold them in assembled relation. An elongate drive roller 54 and a nip roller 56 extend between the plates and are mounted for rotation about their respective axes. The shafts for these rollers can proJect through holes in the end plates. As shown in FIG. 1, a guide 58 deflects a sheet driven upwardly by the rack of rollers 22 into the nip between rollers 54,56 and a similar guide 60 deflects the sheet from rollers 54,56 into the rack of rollers 32 and container 30.

As best illustrated in FIGS. 2 and 3, crossover assembly 26 has an elongate water trough 62. The trough and roller 54 are located with respect to each other so that when water is provided to the trough the roller is partially immersed in the water. Thus, as the roller is rotated and film passes between rollers 54,56, developer solution from the container 20 will be transferred to rollers 54,56. This solution, if left to dry on the rollers, create quality problems in the subsequent film sheets or strips passed through the processor. By rotating roller 54 in the trough water, roller 54 is constantly cleaned and, during periods when there is no film between rollers 54,56, water is transferred from roller 54 to roller 56 to thereby clean the nip roller.

Referring now to FIG. 2, trough 62 has side walls 64,66 which project upwardly from the bottom 68 of the trough. An end wall 70 extends between the side walls and has a drain hole 72 located Just above the bottom 68 for allowing water within the trough to be drained into a suitable container or overflow tank (not shown).

The trough has a second end wall 74 which projects upwardly from the bottom 68 by a distance greater than the end wall 70. Wall 74 has a U-shaped slot 76 which allows shafts at the end of rollers 54,56 to project through wall wall for connection to bearings and drive elements (not shown). Side walls 64,66 have upwardly proJecting portions **64*a*,66*a* adjacent end wall 74. Also, the walls 64,66 each have a step 64*b*,66*b* at the side of portions 64*a*,66*a* opposite from the end wall 74. End plate 50 fits against the elevated portions 64*a*,66*a* of the side walls. The bottom edge of plate 50 is shaped so that a portion of it rests on the steps 64*b*,66*b* and a portion of the plate fits within the trough between side walls 64,66. The lowermost edge of plate 50 within the trough is shown at 58 in FIG. 2, and it is spaced above the bottom wall 68** of the trough so that water can flow under the plate in the trough.

The crossover assembly 36 is the same or essentially the same as assembly 26. Accordingly, the same reference numerals have been used to designate the same or similar parts with a prime added to the numerals for crossover assembly 36. Crossover assembly 36 has wall 66' of the trough 62' positioned over the wash container 38. This permits a drain hole 78 to be provided in wall 66' near end wall 70' to allow water in trough 62' to drain directly into the wash container 38.

The water distributor system of the present invention is generally designated 80 and includes a water distributor 82 having an open channel 84 in the upper surface thereof for carrying water to the troughs 62,62'. The side of the distributor opposite from the channel has a pair of flexible fingers 86 that snap onto bushings 88 on rods 52,52' of the crossover assemblies to locate the distributor relative to the crossover assemblies as shown in the drawings.

The water distributor 82 is generally yoke shaped, and when mounted on the crossover assemblies, the central portion **82*a* of the distributor is located above its end portions 82*b* and 82*c*. Therefore, water deposited into the upper portion 82*a* of the channel 84 will flow by gravity to the end portions 82*b*,82*c*. End portions 82*b* and 82*c* are located above the open troughs 62,62', respectively of the crossover assemblies in the area between plates 50,50' and the end walls 74,74' of the troughs. Thus, water from the distributor is received in the troughs at the end portions thereof opposite from the drain holes 72 and 78**.

Water is delivered to channel 84 of the distributor through a tubular pin 90 that extends from one side of the distributor 80 through the distributor and into channel 84 at the uppermost position **82*a* of the distributor. A cylindrical passageway 92** through the pin is sized to meter the flow of water into the channel.

Figure 4:
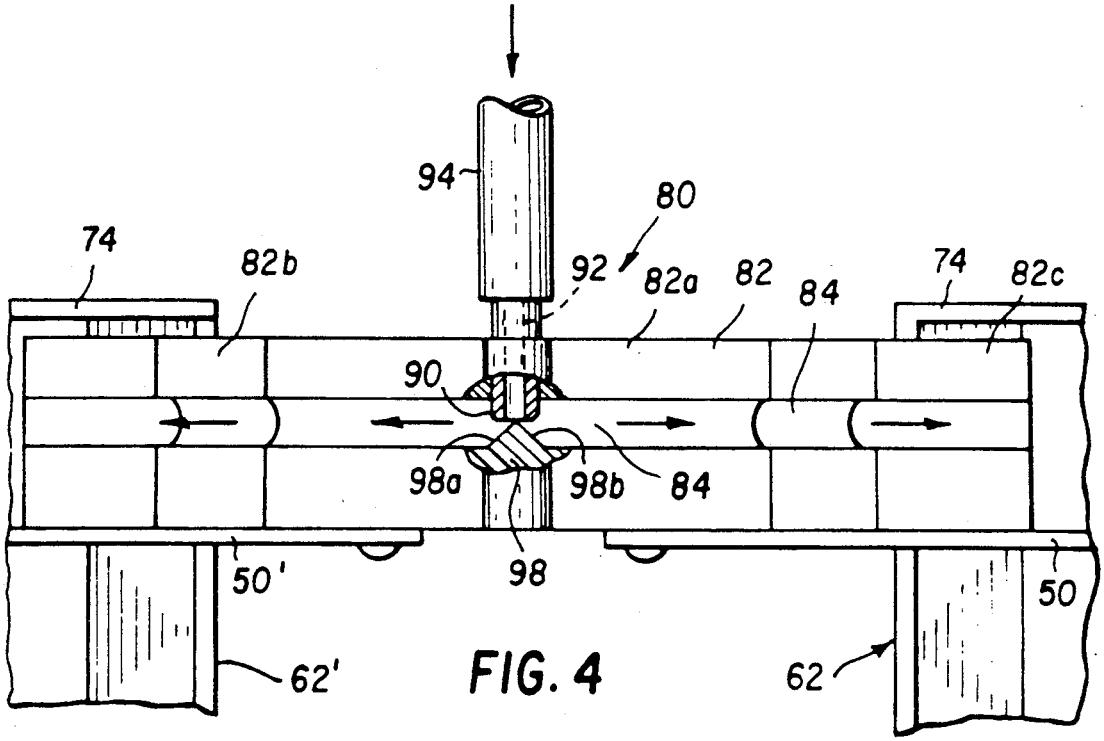
FIG. 4 is a fragmentary top plan view of a water distributor member and portions of the water distributor system and the crossover assemblies.

Water is supplied to the pin 90 through a single conduit 94 that has one end connected to the pin, as best viewed in FIG. 4. The other end of the conduit is connected to a suitable source of water. It is desirable to locate the conduit 94 and connect it to a source of water at the same end of the processor as the distributor 82. This simplifies installation and removal of the various elements of the processor when it is necessary to perform maintenance on the processor, to remove misfed sheets in the processor, etc In the distributor system 80 this is accomplished by providing a fitting 96 at the end of one of the spray headers 48 at the same end of the processor as the distributor 82. The other end of the conduit 94 is connected to the fitting Thus, water from header 48 can flow through the fitting 96 and the tube 94 and then to pin 90 where it is metered into the channel 84 in the distributor.

As shown in FIG. 4, an elongate, vertically extending blade 98 on distributor 82 has sides **98*a*,98*b* that taper to an edge that faces and is aligned with the axis of the passageway 92 in pin 90. The blade 98 and pin 90 extend into the channel 84 in facing relation from opposite sides of the channel. The blade and pin can be in contact, or spaced very close to each other, so that water delivered to the channel through the pin 90 strikes the tapered surfaces 98*a*,98*b* of the blade and is divided into two substantially equal volumes or streams of water. Blade surfaces 98*a*,98*b* deflect the streams of water along the channel toward the end portions 82*b* and 82*c* of the distributor where they flow into the troughs 62,62'**, respectively.

During operation of the processor, water is provided to wash spray headers 48, through fitting 96 and tube 94 to the metering pin 90. As water leaves the metering pin and enters the channel 84, it strikes the surfaces 98*a*,98*b* of the blade 98 and separates into two substantially equal streams of water. These streams flow from the upper portion 82*a* of the distributor along the channel 84 to the end portions 82*b*,82*c* of the distributor. The water streams then fall into the troughs 62,62' adjacent the end walls 74 and 74' thereof. Water travels along the bottom wall 68 of the trough to the drain holes 72,78 located at the opposite ends of the troughs. Thus, fresh water is provided along the full length of the troughs. This water is picked up by the rollers 54,54' of the crossover assemblies. Thus, the rollers 54, 56, 54' and 56' are cleaned of processing solutions transferred to the rollers as film is transported from one container to the other in the processor.

The water distributor system of the invention has several advantages. For example, it utilizes only one tube 94 and fitting 96, and is relatively simple in construction. Therefor, the system is inexpensive and easy to manufacture Also, the system is located at one end of the crossover assemblies so it is easy to assemble and readily disassembled for maintenance and repair. The volume of water supplied to each trough is controlled by metering the water through pin 90 and by the blade dividing the water into two substantially equal streams. Another advantage is that water flows into one end of the troughs and out the other end thereof, thus assuring a fresh supply of water to rollers 54,54'.

The invention has been described in detail with particular reference to a preferred embodiment thereof, but it will be understood that variations and modifications can be effected within the spirit and scope of the invention.

I claim:

1. In an improved water distributor system for crossover assemblies in a film processor, the film processor having first, second and third containers for liquids through which film is successively passed for developing the film, a first crossover assembly located between the first and second containers and a second crossover assembly located between the second and third containers, each crossover assembly comprising an elongate trough for holding water and a rotatable roller located with respect to the trough so that the roller is partially immersed in water in the trough to clean the roller, the film contacting the roller of one of the crossover assemblies as the film travels from one container to another, the improved distribution system comprising:

a water distributor having means defining an elongate path for water, the path defining means having one end located to deliver water to the trough of the first crossover assembly and a second end located to deliver water to the trough of the second crossover assembly, means for metering water to the path defining means at a position between the ends thereof, and means for separating the water from the metering means into a first stream of water directed along the path toward the one end of the path and a second stream of water directed along the path toward the second end of the path.

2. The system as set forth in claim 1 wherein the water distributor is a yoke shaped member, and the path defining means comprises an open channel in the yoke sloping downwardly from the metering means to the troughs.

3. The system as set forth in claim 2 wherein the metering means comprises a tubular member connected to the yoke and to a source of water, the tubular member having a passageway therethrough sized to meter the flow of water to the channel.

4. The system as set forth in claim 2 wherein the separating means comprises a blade carried by the yoke, the blade and metering means being located in facing relation on opposite sides of the channel so that water entering the channel from the metering means strikes the blade and is divided into two streams of water.

5. The system as set forth in claim 1 wherein the third container comprises a wash container, means for supplying water to the third container, and a conduit coupling the metering means to the water supplying means for the third container, and the path defining means and the conduit being located at the same end of the processor to facilitate assembly and removal of the system.

* * * * *